United States Patent [19]

Roth

[11] Patent Number: 4,570,280

[45] Date of Patent: Feb. 18, 1986

[54] ONE PIECE LINT ROLLER SUPPORT

[76] Inventor: Eric M. Roth, 153 Lake Dr. N., N. Ontario, Canada, L4P 3C8

[21] Appl. No.: 667,980

[22] Filed: Nov. 5, 1984

[51] Int. Cl.[4] ..... A47L 25/00

[52] U.S. Cl. ..... 15/104 A; 15/230.11; 29/110.5

[58] Field of Search ..... 15/104 A, 230.11; 29/110.5, 116 R, 120

[56] References Cited

U.S. PATENT DOCUMENTS 3,225,373 12/1965 Kisbany ..... 15/104 A
4,361,923 12/1982 McKay ..... 15/104 A
4,422,201 12/1983 McKay ..... 15/104 A

FOREIGN PATENT DOCUMENTS 0095447 11/1983 European Pat. Off. ..... 15/104 A

*Primary Examiner*—Edward L. Roberts

[57] ABSTRACT

An integral support for an adhesive tape roll sleeve provides a handle and a roll support member. The roll support member has projections to retain the roll on the support. The projections are on resiliently deflectable members which allows them to be deflected inwardly to allow application to or removal of the roll from the support.

3 Claims, 6 Drawing Figures

ONE PIECE LINT ROLLER SUPPORT

Figure 1:
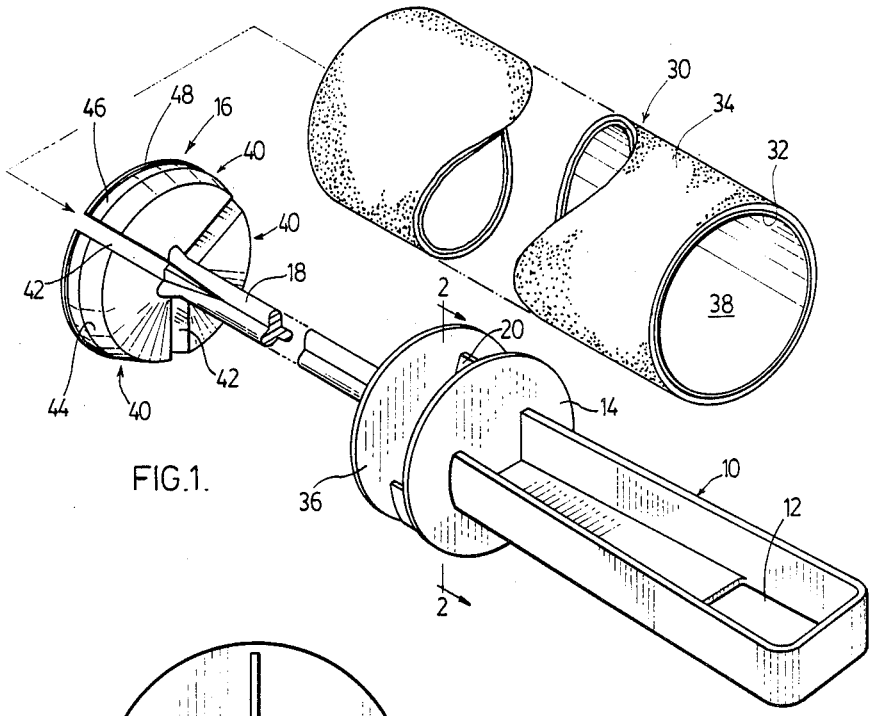

This invention relates to a one piece lint removal roller preferably made of molded plastic.

The lint rollers with which the invention is concerned are those which rotatably mount an adhesive tape roll sleeve carrying adhesive tape with the adhesive surface facing outwardly which is rolled over garments or fabric to remove lint, dust or other small particles therefrom.

A lint roller must combine the qualities of rotatably mounting the adhesive tape sleeve for convenient use while allowing easy removal and replacement of the sleeve when the adhesive roll is used up or clogged.

It has previously been found difficult to provide a lint roller support combining such features in a single integral unit and it has been customary to make the device from two or more separate parts. This adds greatly to the complexity, and cost of the device.

It is an object of this invention to provide a lint roller comprising a support for an adhesive tape roll sleeve of one piece molded construction which allows convenient use of the sleeve for lint removal and convenient replacement of the sleeve, when the adhesive surface thereon is exhausted or clogged.

In the devices with which this invention is concerned the adhesive tape sleeve is removed and replaced by movement relative to its support in one or in the opposite direction parallel to the rotational axis of the sleeve. For convenience in the specification and claims herein, movement of the sleeve relative to the support for removal of the sleeve is defined as being in the 'outward' direction and movement of the sleeve to install it on the support is defined as being in the 'inward' direction.

Directions toward and away from the rotational axis of the sleeve which directions are perpendicular to the above-defined inward and outward directions are referred to as 'radially inward' and 'radially outward'.

It is an object of this invention to provide a lint roller as described in the second preceeding paragraph having a support with inner and outer (note the previous definition of 'inward' and 'outward') guides for the sleeve. Such guides limit inward and outward movement of the sleeve, in use, while allowing its rotation, and the support also provides means which define the location of the inner and outer ends of the sleeve's rotational axis when in use. In accord with one of the principal objects of the invention the outer guide means limits outward movement of the sleeve, in use, by providing members bearing on the outer edge of the sleeve. The invention provides means whereby said outer edge bearing members may be manually and resiliently deflected inward of the inner surface of the sleeve to allow outward removal of the sleeve thereover for replacement.

In a preferred form of the invention described in the previous paragraph the outer guide means comprise a plurality of members radially diverging from a connection to the inner guide means, the outer guide means utilizing flanges to engage, in use, the outer edge of the sleeve, and manually operable means for deflecting the radially diverging members toward the sleeve rotation axis so that the flanges are moved radially inward of the inner surface of the sleeve which may then be moved outward thereover.

In the preferred form of the invention the manually operable means described in the preceeding paragraph comprises radially outwardly facing surfaces on the outer side of the outer guide means for digital engagement and inward pressure when it is desired to move the flanges inward to remove a sleeve.

In drawings which show a preferred embodiment of the invention

Figure 2:
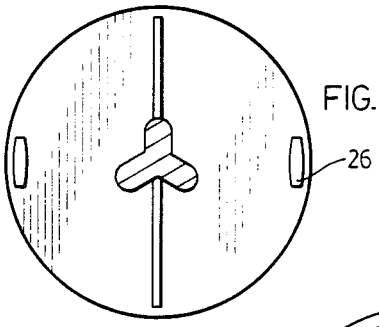
Figure 3:
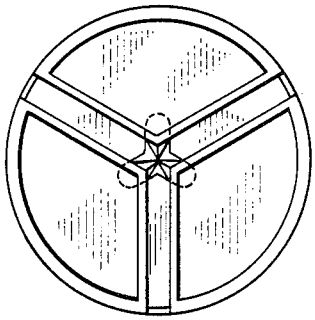
Figure 4:
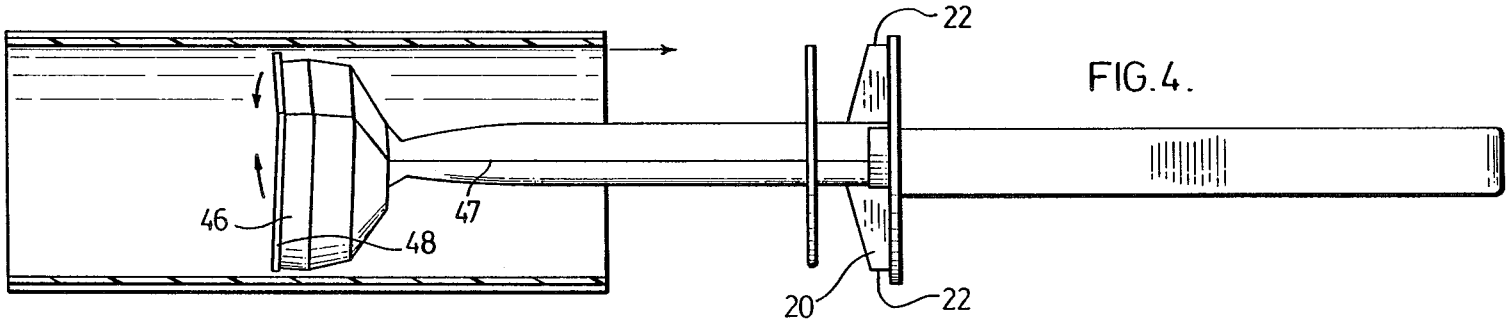
Figure 6:
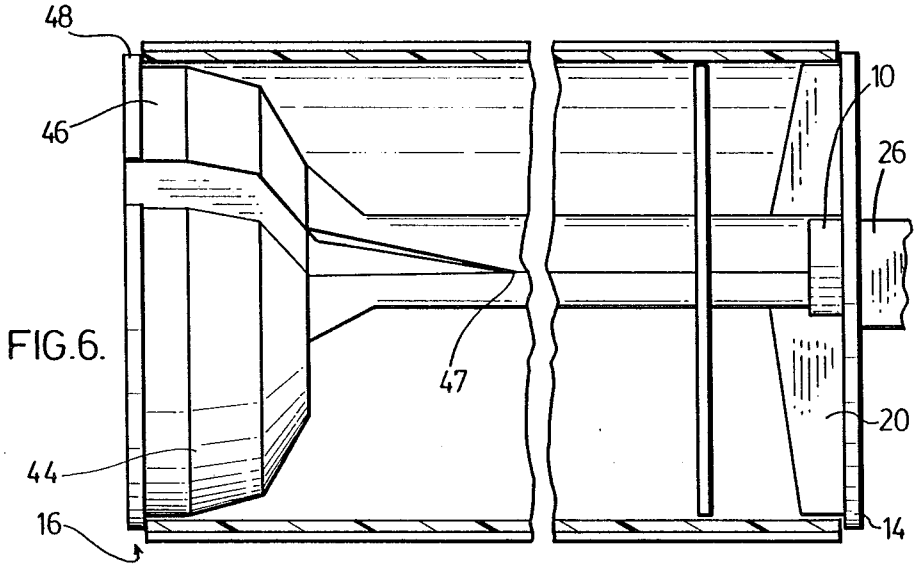
Figure 5:
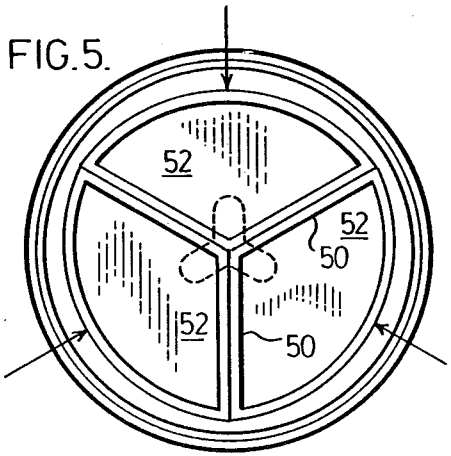

FIG. 1 is a perspective view of the sleeve support accompanied by an 'adhesive tape' roller sleeve, FIG. 2 is a view taken along the lines 2—2 of FIG. 1, FIG. 3 is a view of the outer end of the sleeve support, FIG. 4 is a side view of the support with the sleeve in section showing the installation of a sleeve on the support, FIG. 5 is a view of the outer end of the elements in the position of FIG. 4, and FIG. 6 is a vertical longitudinal section of the support with a sleeve installed thereon.

In the drawings, the preferred embodiment comprises an unitary integrally connected molding comprising a handle, and a support member for the adhesive tape sleeve. The handle 10, which preferably extends longitudinally from the support in a direction parallel to the axis of rotation of the sleeve may be of any form having the required strength and suitable for molding. I prefer the handle shown, of U shape in cross-section with an aperture 12 at the outer end to allow the device to be hung up.

An adhesive tape roller sleeve 80 is shown in FIG. 1 and is a well known and conventional component of many contemporary lint rollers. The sleeve 30 comprises a cardboard inner cylinder 32 and an outer (usually multiple) layer of adhesive tape with the sticky or adhesive side outward. When the sticky side is rolled on clothing or fabric it picks up lint or dust therefrom. As the adhesive is used up or clogged, layers must be removed until all the adhesive layers are used at which point the sleeve must be replaced.

The support member comprises an inner guide means 14 connected to an outer guide means 16 by a connector 18 which is preferably a splined shank having three lobes as shown in FIG. 1. The inner guide means 14 comprised a disk having a diameter to contact the inner edges of an adhesive tape sleeve (see FIG. 6) to limit its inward movement. Formed on the outer face of the disk is an outwardly projecting diametrical rib 20 whose radially outward edges 22 are located to form diametrically opposed supports for the inner end of the inner wall of the sleeve. Outwardly directed ridges 26 are provided which are angularly midway between the outer edges 22 and whose outer surfaces are shaped to support the sleeve 30 for rotational movement thereover about the same axis of rotation as that defined by outer edges 22. Although the means described are sufficient to limit inward movement of the sleeve in the support and to define the inward end of its rotational axis, I have found it preferable to provide a second inner support for the rotating sleeve in the form of disk 36 spaced a short distance outwardly from disk 14. The outer edge of disk 36 is dimensioned to ride on the inner surface 38 of the sleeve 30 and to define thereby the same inner end of the sleeve rotational axis as that defined by supports 26 and edges 22. The outer guide means comprises a plurality (here three) of similar members 40 and one will be described. Each member 40 subtends, about the sleeve rotational axis, an angle of slightly less than 120° so that the three members 40 encompass the full 360° about the rotational axis, with radially directed spaces 42 between them. Each radially directed member (see FIGS. 5 and 6) defines an outer wall 44 having successive surfaces sloping radially outwardly and away from the handle and at their radially outer end providing the radially outwardly facing arcuate surface 46 shaped and dimensioned to slidably support the outer portion of the inner surface of the sleeve on a rotational axis coaxial wall that defined by the inner guide member. Outwardly of the surface 46 each radially directed member 40 is provided with an outwardly direct flange 48 designed to slidably bear on the outer edge of the sleeve cardboard cylinder 32. The outer flange 48 is spaced from disk 14 of the inner guide member to locate the sleeve axially with only sufficient leeway to allow easy sliding of the sleeve edges thereon during rotation. It will be noted that the outer diameters of the disk 14 and the flange 48 must be large enough to bear on the inner and outer edges of the sleeve (on its cardboard cylinder 32) but should not be so large as to project radially outward beyond the adhesive surfaces 34 of the sleeve so that members 14 and 48 will not interfere with the operation of the radially outer adhesive surfaces 48 of the sleeve in picking up lint.

The radially disposed members 40 of the outer guide, whose radially outer surface 46 is shaped as described are provided with two radially inward webs 50 which extend outwardly from the splined central shank 18 to form with surface 46 and flange 48 to the outwardly facing shape of the member 40 which contour is a hollow 120° sector with all dimensions reduced to provide spacing between members 40. It will then be seen, from FIG. 5 that each radially extending member defines outwardly facing cavities 52 between walls 50 and outer wall 46, into which the ends of the fingers may be inserted to press radially inwardly on the radially outwardly facing surfaces of members 50 to deflect them inwardly.

As shown it is preferred to facilitate the inward deflection of the members 40 by attaching each member 40 to a separate spline of the shank 18, the splines being separate at their rearward end and meeting along inwardly converging extents at 47 to form the unitary shank 18.

We prefer to use polypropylene or polystyrene as the plastic from which the devices will be molded as a unitary integral body. The material selected and the dimensioning of the outer guide member must be selected so that the plurality (here three) of the radially extending portions 40 may be manually resiliently deflected inward to allow the sleeve to pass inwardly or outwardly over the flanges 48 and regain their position when the manual pressure is released.

It will be noted that if only two inwardly deflectable members are used that care must be taken to limit the extents of the flanges 48 in directions perpendicular to the inward deflection direction so that on inward deflection of the two members each in an approximate radially inward direction to remove or install a sleeve no part of the flanges extends outwardly of the sleeve inner diameter and thus that the inward movement of the flanges 48 carries them inward of all portions of the outward facing edge of the sleeve. With three, four or more radially directed members, of course, sufficient radial inward movement of each will remove its flanges from the path of the sleeve.

Returning to the preferred embodiment with three radially disposed members 40, the operation of the device is as follows:

To install a sleeve 30 on a support member, the fingers are used to deflect the three radially disposed members 40 inwardly so that the sleeve may be moved inwardly over flange 48 until its inner edge rests against disk 14. As soon as the inner edge of the sleeve 30 passed over the flanges 48 the inner surface of the sleeve itself will retain the flanges 48 and members 40 inward until the sleeve reaches its limiting inner position. At this point the outer edge of the sleeve will have passed inwardly over the flanges 48 releasing them to spring back to slidably rest on the outer edge of the sleeve and limits its outward movement.

The device may then be used by grasping the handle 10 and rolling the adhesive tape sleeve relative to its support over the surface to be cleaned. When it is desired to replace the roller 30, the fingers are inserted in the outwardly facing cavities 52 of the outer guide sufficiently to deflect its radially disposed members sufficiently 40 to allow the inner surface of the sleeve to be slid thereover. Once the inner surface of the sleeve has started to pass over the flanges 48, this surface will retain the flanges inward, without the assistance of the fingers while the sleeve is removed the rest of the way. When removed the members 40 and flanges 48 again spring outward to their rest position. A new roller is installed as described at the start of the operation.

I claim:

1. Integrally molded support for adhesive roll sleeve comprising:

a support member and a handle integrally extending therefrom;

said support member having a longitudinally extending shank, means at the handle-adjacent end of said shank for rotatably supporting the inward end of an adhesive roll sleeve and for limiting movement of such sleeve toward said handle, means at the handle-remote end of said shank for rotatably supporting the outward end of such adhesive roll sleeve and for limiting movement of such sleeve away from said handle, said means at the handle-remote end comprising a plurality of guide members angularly disposed about the axis of rotation of said sleeve, each providing a radially outwardly facing support surface and a flange located at the handle remote edge of said support surface and radially outwardly directed therefrom; said support surfaces collectively being designed to collectively rotatably support the outward end of said sleeve and said flange being designed to collectively limit movement of said roller away from said handle, said guide members being shaped so that their radially inward deflection moves said flanges inward to allow said sleeve to pass outwardly thereover, said guide members being resiliently deflectably connected to said shank, said guide members being provided with digitally engageable surfaces facing away from said handle and located radially inwardly of said flanges.

2. Integrally molded support for adhesive roll sleeve comprising:

a support member and a handle integrally extending therefrom;

said support member having a longitudinally extending shank, means at the handle-adjacent end of said shank for rotatably supporting the inward end of an adhesive roll sleeve and for limiting movement of such sleeve away from said handle, said means at the handle-remote end comprising three guide members angularly disposed about the axis of rotation of said sleeve, each providing a radially outwardly facing support surface and a flange located at the handle-remote edge of said support surface and radially outwardly directed therefrom; said support surfaces being designed to collectively rotatably support the outward end of said sleeve and said flanges being designed to collectively limit movement of said roller away from said handle, said guide members being shaped so that their radially inward deflection moves said flanges inward to allow said sleeve to pass outwardly thereover, said shank adjacent the handle remote end being split into three separate extents, each extent being connected to one of said guide members to resiliently deflectably connect said guide member to said shank.

3. Integrally molded support for adhesive roll sleeve as claimed in claim 2 wherein:

said guide members are provided with digitally engageable surfaces facing away from said handle and located radially inwardly of said flange portions.

* * * * *